US010706789B2

(12) United States Patent
Hua et al.

(10) Patent No.: US 10,706,789 B2
(45) Date of Patent: Jul. 7, 2020

(54) PIXEL DRIVING CIRCUIT AND DRIVING METHOD THEREOF, AND DISPLAY DEVICE

(71) Applicants: BOE Technology Group Co., Ltd., Beijing (CN); Hefei BOE Optoelectronics Technology Co., Ltd., Hefei (CN)

(72) Inventors: Lei Hua, Beijing (CN); Jie Ling, Beijing (CN); Donghui Wang, Beijing (CN)

(73) Assignees: BOE TECHNOLOGY GROUP CO., LTD., Beijing (CN); HEFEI BOE OPTOELECTRONICS TECHNOLOGY CO., LTD., Anhui (CN)

( * ) Notice: Subject to any disclaimer, the term of this patent is extended or adjusted under 35 U.S.C. 154(b) by 0 days.

(21) Appl. No.: 16/203,875

(22) Filed: Nov. 29, 2018

(65) Prior Publication Data

US 2019/0347998 A1 Nov. 14, 2019

(30) Foreign Application Priority Data

May 8, 2018 (CN) ..... 2018 1 0431269

(51) Int. Cl.
*G09G 3/3291* (2016.01)
*G09G 3/3258* (2016.01)

(52) U.S. Cl.
CPC ..... *G09G 3/3291* (2013.01); *G09G 3/3258* (2013.01); *G09G 2300/043* (2013.01);
(Continued)

(58) Field of Classification Search
CPC ..... G09G 3/3291; G09G 3/3258; G09G 2300/0426; G09G 2300/043;
(Continued)

(56) References Cited

U.S. PATENT DOCUMENTS

2008/0211397 A1 9/2008 Choi
2013/0321375 A1* 12/2013 Ka ..... G09G 3/3233 345/212
2015/0269890 A1* 9/2015 Ma ..... G09G 3/3291 345/215

FOREIGN PATENT DOCUMENTS

CN 101976545 A 2/2011
CN 102903333 A * 1/2013
(Continued)

OTHER PUBLICATIONS

First office action of Chinese application No. 201810431269.3 dated Aug. 5, 2019.

*Primary Examiner* — Brent D Castiaux
(74) *Attorney, Agent, or Firm* — Fay Sharpe LLP

(57) ABSTRACT

A pixel driving circuit, a driving method thereof, and a display device are provided. According to the pixel driving circuit, a data voltage is provided to a first electrode of a driving transistor; a storage sub-circuit is charged or discharged; a first voltage signal from a first voltage terminal is provided to a control electrode of the driving transistor, and a second voltage signal from a second voltage terminal or a third voltage signal from a third voltage terminal is provided to a first node; the data voltage and a threshold voltage of the driving transistor are written to the control electrode of the driving transistor, to turn on a second electrode of the driving transistor and the third voltage terminal, to control a light-emitting element to emit light.

6 Claims, 5 Drawing Sheets

(52) U.S. Cl.
CPC . *G09G 2300/0426* (2013.01); *G09G 2310/08* (2013.01); *G09G 2320/0233* (2013.01)

(58) Field of Classification Search
CPC ..... G09G 2310/08; G09G 2320/0233; G09G 3/3233; G09G 2300/0819; G09G 2300/0861; G09G 2300/0842
See application file for complete search history.

(56) References Cited

FOREIGN PATENT DOCUMENTS

| | | | |
|---|---|---|---|
| CN | 103456264 | A | 12/2013 |
| CN | 106652916 | A | 5/2017 |
| JP | 2009058621 | A | 3/2009 |

* cited by examiner

PIXEL DRIVING CIRCUIT AND DRIVING METHOD THEREOF, AND DISPLAY DEVICE

This application claims priority to Chinese Patent Application No. 201810431269.3, filed on May 8, 2018 and titled "DISPLAY DEVICE, PIXEL DRIVING CIRCUIT AND DRIVING METHOD THEREOF", the entire contents of which are incorporated herein by reference.

TECHNICAL FIELD

The present disclosure relates to the field of display technology, and in particular to a pixel driving circuit, a display device and a driving method of a pixel driving circuit.

BACKGROUND

In recent years, the demand for the organic light-emitting diode (OLED) display technology is increasing. Especially, the application to small-sized flexible curved screens and large-sized display devices such as curved televisions gains more and more attention in the display industry.

Compared with other displays, the OLED display devices have advantages of self-luminance, full-color display, wide viewing angle, high brightness, high contrast, low power consumption, etc., and thus have a broad market. However, the related art has a problem that the conventional 2T1C (i.e., 2 transistors and 1 capacitor) pixel driving circuit only converts a voltage signal into a current signal simply, without taking the problem of fluctuation of a turn-on voltage caused by the process fluctuation during the manufacturing process of the transistor into consideration. As a result, the problem of image quality, such as obvious spots and Mura (i.e., uneven brightness), of a display picture of the OLED display device occurs, and the display quality of the products is affected.

SUMMARY

In an aspect, embodiments of the present disclosure provide a pixel driving circuit, comprising: a light-emitting element, a driving transistor, a storage sub-circuit, a data writing sub-circuit, a light-emitting control sub-circuit, a charging control sub-circuit, and a threshold voltage compensation sub-circuit, wherein the data writing sub-circuit is coupled to the driving transistor and configured to provide a data voltage provided by a data line for a first electrode of the driving transistor under the control of a selection signal terminal; the storage sub-circuit is coupled to a control electrode of the driving transistor and a first node respectively, and is configured to to charged or discharged, under the control of a signal from the first node and a signal from the control electrode of the driving transistor; the charging control sub-circuit is coupled to the first node and the control electrode of the driving transistor respectively, and configured to provide a first voltage signal from a first voltage terminal for the control electrode of the driving transistor under the control of a first signal terminal and provide a second voltage signal from a second voltage terminal or a third voltage signal from a third voltage terminal for the first node under the control of a second signal terminal and a third signal terminal; the threshold voltage compensation sub-circuit is coupled to the control electrode of the driving transistor and a second electrode of the driving transistor respectively, and configured to couple the control electrode of the driving transistor to the second electrode of the driving transistor under the control of a fourth signal terminal, to write the data voltage and a threshold voltage of the driving transistor to the control electrode of the driving transistor; and the light-emitting control sub-circuit is coupled to the light-emitting element, the driving transistor, and the charging control sub-circuit respectively, and configured to turn on the second electrode of the driving transistor and a first terminal of the light-emitting element under the control of a first light-emitting control signal terminal, and turn on the first electrode of the driving transistor and the third voltage terminal under the control of a second light-emitting control signal terminal, to control the light-emitting element to emit light.

Optionally, the data writing sub-circuit comprises: a first transistor, wherein a first electrode of the first transistor is coupled to the data line, a control electrode of the first transistor is coupled to the selection signal terminal, and a second electrode of the first transistor is coupled to the first electrode of the driving transistor and the light-emitting control sub-circuit respectively.

Optionally, the threshold voltage compensation sub-circuit comprises: a second transistor, wherein a first electrode of the second transistor is coupled to the second electrode of the driving transistor, a second electrode of the second transistor is coupled to the control electrode of the driving transistor and a first terminal of the storage sub-circuit, and a control electrode of the second transistor is coupled to a fourth signal terminal.

Optionally, the charging control sub-circuit comprises: a third transistor, wherein a first electrode of the third transistor is coupled to the threshold voltage compensation sub-circuit and the first terminal of the storage sub-circuit, a second electrode of the third transistor is coupled to the first voltage terminal, and a control electrode of the third transistor is coupled to the first signal terminal; a fourth transistor, wherein a first electrode of the fourth transistor is coupled to the first node, a second electrode of the fourth transistor is coupled to the second voltage terminal, and a control electrode of the fourth transistor is coupled to the second signal terminal; and a seventh transistor, wherein a first electrode of the seventh transistor is coupled to the light-emitting control sub-circuit and the third voltage terminal respectively, a second electrode of the seventh transistor is coupled to the first node, and a control electrode of the seventh transistor is coupled to the third signal terminal.

Optionally, the light-emitting control sub-circuit comprises: a fifth transistor, wherein a first electrode of the fifth transistor is coupled to the second electrode of the driving transistor, a second electrode of the fifth transistor is coupled to the light-emitting element, and a control electrode of the fifth transistor is coupled to the first light-emitting control signal terminal; and a sixth transistor, wherein a first electrode of the sixth transistor is coupled to the third voltage terminal, a second electrode of the sixth transistor is coupled to the first electrode of the driving transistor, and a control electrode of the sixth transistor is coupled to the second light-emitting control signal terminal.

Optionally, the storage sub-circuit comprises a storage capacitor.

Optionally, the selection signal terminal and the fourth signal terminal are the same signal terminal.

Optionally, the third signal terminal, the first light-emitting control signal terminal and the second light-emitting control signal terminal are the same signal terminal.

Optionally, the light-emitting element is an organic light-emitting diode.

Optionally, the driving transistor and the transistors in each sub-circuit are P-type transistors.

In another aspect, embodiments of the present disclosure provide a display device comprising the pixel driving circuit described above.

Optionally, the display device further comprises: a driving device; wherein the driving device is coupled to the first signal terminal, the second signal terminal, the third signal terminal, the fourth signal terminal, the first light-emitting control signal terminal, the second light-emitting control signal terminal, the selection signal terminal and the data line respectively, and configured to control a data voltage of the data line and a voltage of a signal provided by each signal terminal.

Optionally, the driving device comprises: a timing controller, a source electrode driving circuit, and a gate electrode driving circuit; wherein the timing controller is coupled to the first signal terminal, the second signal terminal, the third signal terminal, the fourth signal terminal, the first light-emitting control signal terminal, and the second light-emitting control signal terminal respectively; the source electrode driving circuit is coupled to the timing controller and the data line respectively, and is configured to control the data voltage of the data line under the control of the timing controller; and the gate electrode driving circuit is coupled to the timing controller and the selection signal terminal respectively, and configured to control a voltage of a selection signal provided by the selection signal terminal under the control of the timing controller.

In yet another aspect, embodiments of the present disclosure provide a driving method of a pixel driving circuit, which can be used to drive the pixel driving circuit described above. The method includes: providing, by a first signal terminal and a second signal terminal respectively, a turn-on signal to the charging control sub-circuit, to enable a first voltage signal from a first voltage terminal to be provided to the control electrode of the driving transistor, and a second voltage signal from a second voltage terminal to be provided to the first node, to charge the storage sub-circuit; providing, by the selection signal terminal, the turn-on signal to the data writing sub-circuit, to enable a data voltage provided by a data line to be provided to a first electrode of the driving transistor; and providing, by a fourth signal terminal, the turn-on signal to the threshold voltage compensation sub-circuit, to enable the control electrode of the driving transistor to be coupled to the second electrode of the driving transistor, to write the data voltage and a threshold voltage of the driving transistor to the control electrode of the driving transistor; and providing, by the third signal terminal, the turn-on signal to the charging control sub-circuit, to enable a third voltage signal from the third voltage terminal to be provided to the first node; and providing, by the first light-emitting control signal terminal and the second light-emitting control signal terminal, the turn-on signals to the light-emitting control sub-circuit, to provide the third voltage signal from the third voltage terminal to the first electrode of the driving transistor and to turn on the second electrode of the driving transistor and a first terminal of the light-emitting element, to control the light-emitting element to emit light.

Optionally, an absolute value of a difference between a voltage of the first voltage signal and the data voltage is larger than the threshold voltage of the driving transistor.

Optionally, a selection signal provided by the selection signal terminal is the same as a fourth signal provided by the fourth signal terminal.

Optionally, a third signal provided by the third signal terminal, a first light-emitting control signal provided by the first light-emitting control signal terminal, and a second light-emitting control signal provided by the second fight-emitting control signal terminal are the same.

Optionally, the selection signal terminal, the third signal terminal, the fourth signal terminal, the first light-emitting control signal terminal, and the second light-emitting control signal terminal all provide turn-off signals when the first signal terminal and the second signal terminal both provide the turn-on signals; the second signal terminal provides the turn-on signal, and the first signal terminal, the third signal terminal, the first light-emitting control signal terminal and the second light-emitting control signal terminal all provide the turn-off signals when the selection signal terminal and the fourth signal terminal both provide the turn-on signals; and the selection signal terminal, the first signal terminal, the second signal terminal and the fourth signal terminal all provide the turn-off signals when the third signal terminal, the first light-emitting control signal terminal, and the second light-emitting control signal terminal all provide the turn-on signals.

Optionally, the turn-on signal is a high-level signal relative to the turn-off signal.

Optionally, a voltage of the second voltage signal is 0, a voltage of the first voltage signal is a negative voltage, and a voltage of the third voltage signal is a positive voltage.

DETAILED DESCRIPTION

Figure 1:
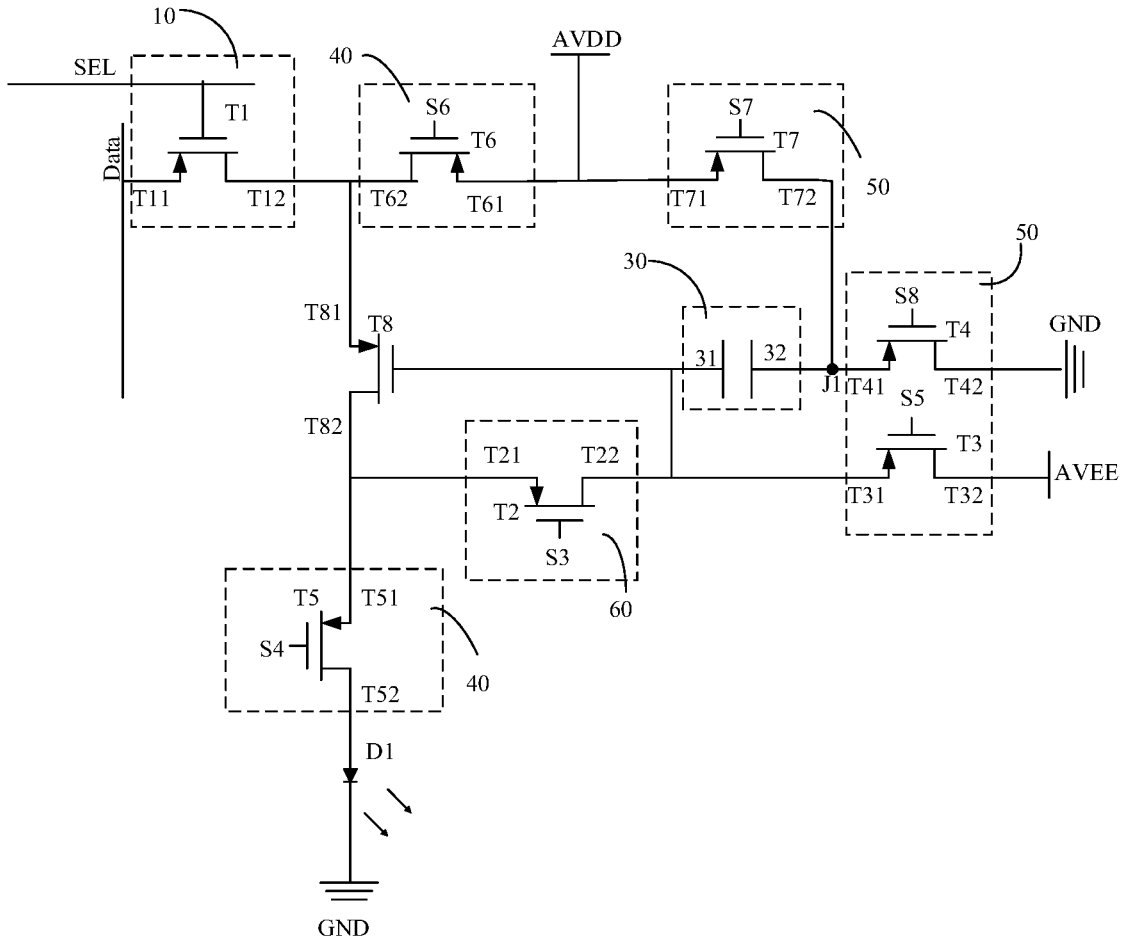
FIG. 1 is a schematic circuit diagram of a pixel driving circuit according to an embodiment of the present disclosure.

Hereinafter, the embodiments of the present disclosure will be described in detail. The embodiments are shown in the drawings. The same or similar numerals throughout denote the same or similar elements or the elements having the same or similar function. The embodiments described below with reference to the accompanying drawings are exemplary only, and are used to to explain the present disclosure rather than limit the present disclosure.

The method, circuit and device according to embodiments of the present disclosure are described below with reference to the accompanying drawings.

In the embodiments of the present disclosure, the control electrode of each transistor in the pixel driving circuit is a gate electrode. One of the first electrode and the second electrode of each transistor is a source electrode and the other is a drain electrode.

FIG. 1 is a schematic circuit diagram of a pixel driving circuit according to an embodiment of the present disclosure. As shown in FIG. 1, the pixel driving circuit 100 in the embodiments of the present disclosure includes: a light-emitting element D1, a driving transistor T8, a storage sub-circuit 30, a data writing sub-circuit 10, a light-emitting control sub-circuit 40, a charging control sub-circuit 50, and a threshold voltage compensation sub-circuit 60.

The data writing sub-circuit 10 is coupled to the driving transistor T8 and configured to provide a data voltage $V_{data}$ provided by a data line Data to a first electrode T81 of the driving transistor T8 under the control of a selection signal terminal SEL.

For example, as shown in FIG. 1, the data writing sub-circuit 10 is coupled to the data line Data, the selection signal terminal SEL, and the first electrode T81 of the driving transistor T8 respectively.

The storage sub-circuit 30 is coupled to the control electrode of the driving transistor T8 and a first node J1 respectively, and configured to charge or discharge under the control of a signal from the first node J1 and a signal from the control electrode of the driving transistor T8. Here, under the control of the signal from the first node J1 and the signal from the control electrode of the driving transistor T8, when the absolute value of a voltage difference between the two terminals of the storage sub-circuit 30 becomes large, it is equivalent of the storage sub-circuit 30 being controlled to be charged. When the absolute value of the voltage difference between the two terminals of the storage sub-circuit 30 becomes small, it is equivalent that the storage sub-circuit 30 is controlled to be discharged.

In the embodiments of the present disclosure, the storage sub-circuit 30 may also maintain a stable voltage difference between the first node J1 and the control electrode of the driving transistor T8 when the control electrode of the driving transistor T8 is in a floating state, or when the first node J1 is in a floating state. Here, the floating state may refer to a state in which the voltage is uncertain. When a certain node is not coupled to any voltage terminal or signal terminal, the voltage of the node is in an uncertain state, that is, the node is in the floating state.

The charging control sub-circuit 50 is coupled to the first node J1 and the control electrode of the driving transistor T8 respectively, and configured to provide the first voltage signal from a first voltage terminal AVEE to the control electrode of the driving transistor T8 under the control of a first signal terminal S5, and provide the second voltage signal from a second voltage terminal GND or the third voltage signal from a third voltage terminal AVDD to the first node J1 under the control of a second signal terminal S8 and a third signal terminal S7.

Exemplarily, as shown in FIG. 1, the charging control sub-circuit 50 is further coupled to the first signal terminal S5, the second signal terminal S8, the third signal terminal S7, the first voltage terminal AVEE, the second voltage terminal GND, and the third voltage terminal AVDD respectively. The charging control sub-circuit 50 may provide the second voltage signal from the second voltage terminal GND to the first node J1 under the control of the second signal terminal S8, and provide the third voltage signal from the third voltage terminal AVDD to the first node J1 under the control of the third signal terminal S7.

The threshold voltage compensation sub-circuit 60 is coupled to the control electrode of the driving transistor T8 and the second electrode T82 of the driving transistor T8 respectively, and configured to couple the control electrode of the driving transistor T8 to the second electrode T82 of the driving transistor T8 under the control of a fourth signal terminal S3, to write the data voltage $V_{data}$ and a threshold voltage $V_{th}$ of the driving transistor T8 to the control electrode of the driving transistor T8. Here, the threshold voltage may also be referred to as a turn-on voltage.

The light-emitting control sub-circuit 40 is coupled to the light-emitting element D1, the driving transistor T8 and the charging control sub-circuit 50 respectively, and configured to turn on the second electrode T82 of the driving transistor T8 and a first terminal of the light-emitting element D1 under the control of the first light-emitting control signal terminal S4, and turn on the first electrode T81 of the driving transistor T8 and the third voltage terminal AVDD under the control of the second light-emitting control signal terminal S6, to control the light-emitting element D1 to emit light.

Exemplarily, the light-emitting control sub-circuit 40 is coupled to the first terminal of the light-emitting element D1, the first electrode T81 of the driving transistor T8, the second electrode T82 of the driving transistor T8, the first light-emitting control signal terminal S4, the second light-emitting control signal terminal S6 and the third voltage terminal AVDD respectively.

The light-emitting brightness of the light-emitting element D1 is related to the magnitude of the drain current flowing through the driving transistor T8. The magnitude of the drain current is further related to the difference value between the gate-source voltage of the driving transistor T8 (i.e., the voltage difference between the gate voltage and the source voltage) and the threshold voltage. In the embodiments of the present disclosure, since the threshold voltage compensation sub-circuit 60 can write the threshold voltage of the driving transistor T8 to the control electrode thereof, when the light-emitting element D1 is driven to emit light, the magnitude of the drain current flowing through the driving transistor T8 is not related to the magnitude of the threshold voltage of the driving transistor T8. Therefore, the problem of uneven brightness of the display device caused by the fluctuation of the threshold voltage of the driving transistor can be avoided.

In summary, according to the pixel driving circuit provided by the embodiments of the present disclosure, the threshold voltage compensation sub-circuit can write the data voltage and the threshold voltage of the driving transistor to the control electrode of the driving transistor under the control of the fourth signal terminal. Therefore, when the light-emitting control sub-circuit turns on the first electrode of the driving transistor and the third voltage terminal under the control of the second light-emitting control signal terminal, to control the light-emitting element to emit light, the magnitude of the drain current flowing through the driving transistor for driving the light-emitting element is not related to the threshold voltage of the driving transistor. Therefore, the problem of uneven brightness or obvious spots of the display device caused by the fluctuation of the threshold voltage of the driving transistor can be avoided, and the display effect of the display device is ensured.

As shown in FIG. 1, in the embodiments of the present disclosure, the data writing sub-circuit 10 includes a first transistor T1. A first electrode T11 of the first transistor T1 is coupled to the data line Data. A control electrode of the first transistor T1 is coupled to the selection signal terminal SEL. A second electrode T12 of the first transistor T1 is coupled to the first electrode T81 of the driving transistor T8 and the light-emitting control sub-circuit 40 respectively.

Optionally, the first transistor T1 may be turned on when the selection signal provided by the selection signal terminal SEL is at a high level, to provide the data signal provided by the data line Data to the first electrode T81 of the driving transistor T8.

The threshold voltage compensation sub-circuit 60 includes a second transistor T2. A first electrode T21 of the second transistor T2 is coupled to the second electrode T82 of the driving transistor T8. A second electrode T22 of the second transistor T2 is coupled to the control electrode of the driving transistor T8 and the first terminal 31 of the storage sub-circuit 30. A control electrode of the second transistor T2 is coupled to the fourth signal terminal S3.

Optionally, the second transistor T2 may be turned on when the fourth signal provided by the fourth signal terminal S3 is at a high level, to couple the control electrode of the driving transistor T8 to the second electrode T82 of the driving transistor T8.

Figure 2:
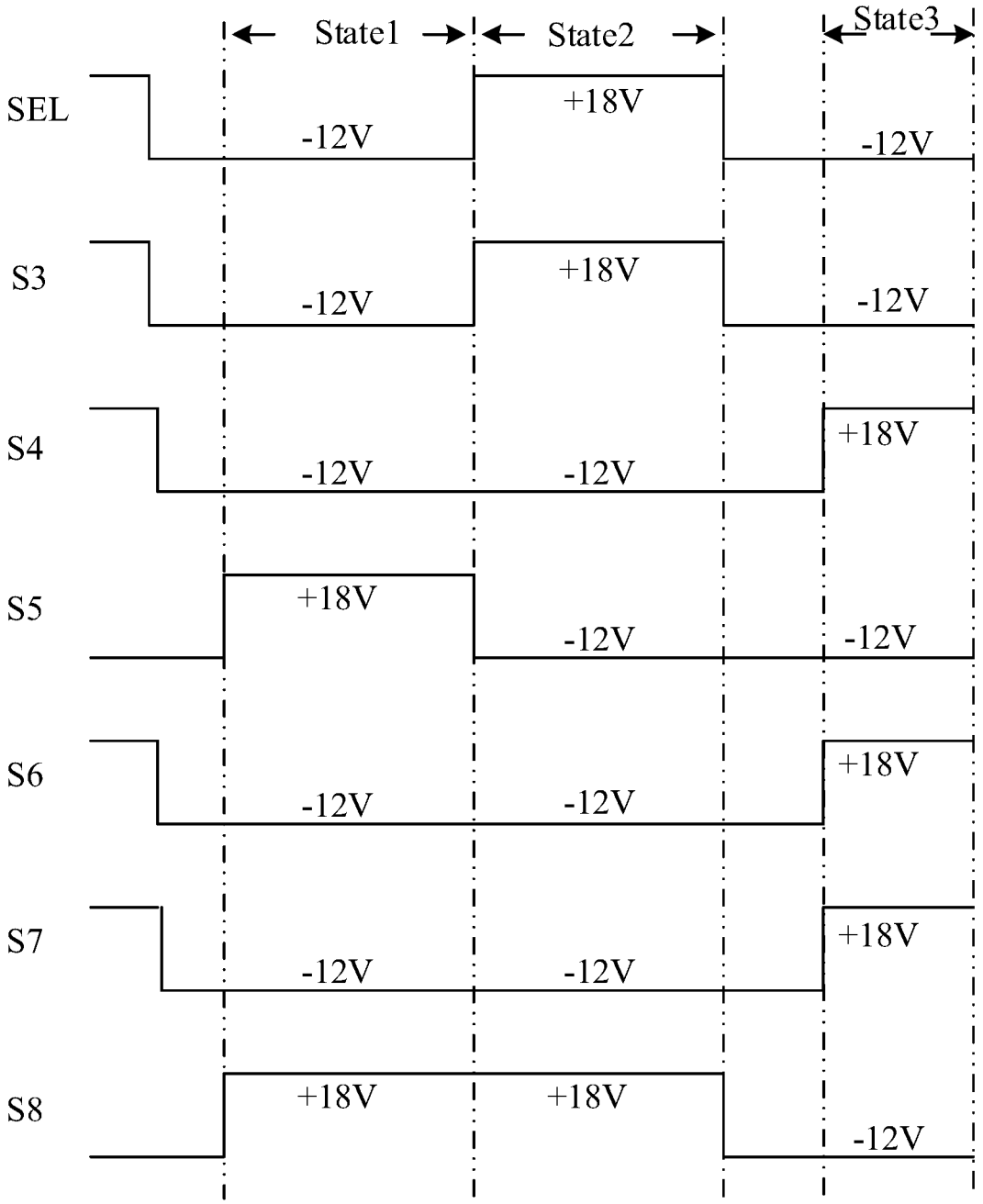
FIG. 2 is a control timing diagram of a pixel driving circuit according to an embodiment of the present disclosure.

As shown in FIG. 2, the selection signal provided by the selection signal terminal SEL is the same as the fourth signal provided by the fourth signal terminal S3, or the selection signal terminal SEL and the fourth signal terminal S3 are the same signal terminal. That is, the selection signal and the fourth signal may be simultaneously at a low level or high level. Here, for the selection signal and the fourth signal, the low-level voltage value may be −12V, and the high-level voltage value may be +18V.

Further, as shown in FIG. 1, the charging control sub-circuit 50 includes a third transistor T3, a fourth transistor T4, and a seventh transistor T7. A first electrode T31 of the third transistor T3 is coupled to the threshold voltage compensation sub-circuit 60 and the first terminal 31 of the storage sub-circuit 30. A second electrode T32 of the third transistor T3 is coupled to the first voltage terminal AVEE. A control electrode of the third transistor T3 is coupled to the first signal terminal S5. A first electrode T41 of the fourth transistor T4 is coupled to the first node J1. A second electrode T42 of the fourth transistor T4 is coupled to the second voltage terminal GND. A control electrode of the fourth transistor T4 is coupled to the second signal terminal S8. A first electrode T71 of the seventh transistor T7 is coupled to the light-emitting control sub-circuit 40 and the third voltage terminal AVDD respectively. A second electrode T72 of the seventh transistor T7 is coupled to the first node J1. A control electrode of the seventh transistor T7 is coupled to the third signal terminal S7.

Optionally, the third transistor T3 may be turned on when a first signal provided by the first signal terminal S5 is at a high level, to provide the first voltage signal from the first voltage terminal AVEE to the control electrode of the driving transistor T8. The fourth transistor T4 may be turned on when a second signal provided by the second signal terminal S8 is at a high level, to provide the second voltage signal from the second voltage terminal GND to the first node J1. The seventh transistor T7 may be turned on when a third signal provided by the third signal terminal S7 is at a high level, to provide the third voltage signal from the third voltage terminal AVDD to the first node J1.

Here, the voltage of the second voltage signal provided by the second voltage terminal GND may be a low-level voltage. In the embodiments of the present disclosure, the second voltage terminal GND is the ground, that is, the second voltage terminal GND may be grounded. The first voltage terminal AVEE may be a negative power supply terminal. For example, the voltage of the first voltage signal provided by the first voltage terminal AVEE may be −5V. The third voltage terminal AVDD may be a positive power supply terminal. For example, the voltage of the third voltage signal provided by the third voltage terminal AVDD may be 5V.

The light-emitting control sub-circuit 40 includes a fifth transistor T5 and a sixth transistor T6. A first electrode T51 of the fifth transistor T5 is coupled to the second electrode T82 of the driving transistor T8. A second electrode T52 of the fifth transistor T5 is coupled to the light-emitting element D1. A control electrode of the fifth transistor T5 is coupled to the first light-emitting control signal terminal S4. A first electrode T61 of the sixth transistor T6 is coupled to the third voltage terminal AVDD. A second electrode T62 of the sixth transistor T6 is coupled to the first electrode T81 of the driving transistor T8. A control electrode of the sixth transistor T6 is coupled to the second light-emitting control signal terminal S6.

Optionally, the fifth transistor T5 may be turned on when the first light-emitting control signal provided by the first light-emitting control signal terminal S4 is at a high level, to turn on the second electrode T82 of the driving transistor T8 and the first terminal of the light-emitting element D1. The sixth transistor T6 may be turned on when the second light-emitting control signal provided by the second light-emitting control signal terminal S6 is at a high level, to turn on the first electrode T81 of the driving transistor T8 and the third voltage terminal AVDD.

Here, the third signal provided by the third signal terminal S7, the first light-emitting control signal provided by the first light-emitting control signal terminal S4 and the second light-emitting control signal provided by the second light-emitting control signal terminal S6 are the same, or the third signal terminal S7, the first light-emitting control signal terminal S4 and the second light-emitting control signal terminal S6 are the same signal terminal. That is, the third signal, the first light-emitting control signal, and the second light-emitting control signal may be all at a low level or high level. Here, for the third signal, the first light-emitting control signal, and the second light-emitting control signal, the low-level voltage value may be −12V, and the high-level voltage value may be +18V.

Here, the storage sub-circuit 30 may be a storage capacitor.

Optionally, the light-emitting element D1 may be an OLED. The first terminal of the light-emitting element D1 is the anode of the OLED, and the second terminal of the light-emitting element D1 is the cathode of the OLED. It can be seen from FIG. 1 that the cathode of the OLED may be coupled to the second voltage terminal GND.

It should be noted that in the above pixel driving circuit provided in the embodiments of the present disclosure, all of the first transistor T1 to the seventh transistor T7 may be switching transistors. The driving transistor T8 and the switching transistor may be thin film transistors (TFT), and may also be metal oxide semiconductor field-effect transistors (MOSFET), which is not limited herein. In the pixel driving circuit provided in the embodiments of the present disclosure, the control electrode of each transistor is taken as the gate electrode of the transistor. Besides, the first electrode may be taken as the source electrode of the transistor and the second electrode may be taken as the drain electrode of the transistor according to the type of the transistor and the difference of the signals from the signal terminals. Alternatively, the first electrode may be taken as the drain electrode of the transistor, and the second electrode may be taken as the source electrode of the transistor, which is not limited herein. Moreover, in the embodiments of the present disclosure, illustration is given by taking an example in which the driving transistor and the switching transistor are thin film transistors.

Optionally, in the embodiments of the present disclosure, the driving transistor and the switching transistors in each sub-circuit may be P-type transistors, or may also be N-type transistors.

The working principle of the pixel driving circuit provided in the embodiments of the present disclosure will be illustrated below according to timing stages in FIG. 2 and the circuit schematic diagram of FIG. 1.

As shown in FIG. 2, in the embodiments of the present disclosure, the driving stage of the pixel driving circuit may be divided into three stages: an initialization stage State1, a turn-on voltage compensation stage State2, and a display stage State3.

The three stages are illustrated by taking an example in which each transistor in the pixel driving circuit is a P-type transistor, and the turn-on signal (i.e., a signal for turning on the transistor) provided by each signal terminal is a high-level signal relative to the turn-off signal (i.e., a signal for turning off the transistor).

Referring to FIG. 2, in the initialization stage State1, the selection signal terminal SEL, the fourth signal terminal S3, the first light-emitting control signal terminal S4, all of the second light-emitting control signal terminal S6, and the third signal terminal S7 are controlled to provide a low-level signal (that is, all provide a turn-off signal), for example, a signal having a voltage value of −12V, so that the first transistor T1, the second transistor T2, the fifth transistor T5, the sixth transistor T6, and the seventh transistor T7 all work in a cut-off region (i.e., turned off). In the initialization stage State1, the signals provided by the first signal terminal S5 and the second signal terminal S8 may be set to be at a high level (i.e., the first signal terminal S5 and the second signal terminal S8 both provide the turn-on signals). For example, the first signal terminal S5 and the second signal terminal S8 may both provide the signal having a voltage value of +18V, such that the third transistor T3 and the fourth transistor T4 work in a saturation region (i.e., turned on).

In other words, in the initialization stage State1, the third transistor T3 and the fourth transistor T4 of the charging control sub-circuit 50 are in a turn-on working state. In this case, the first voltage terminal AVEE charges the storage sub-circuit 30 via the third transistor T3. The voltage of the first voltage signal provided by the first voltage terminal AVEE is written to the first terminal 31 of the storage sub-circuit 30. Since the control electrode of the driving transistor T8 is also coupled to the first terminal 31 of the storage sub-circuit 30, the control electrode of the driving transistor T8 also has a voltage with a value equal to the voltage value of the first voltage signal provided by the first voltage terminal AVEE. The voltage value of the first voltage signal provided by the first voltage terminal AVEE may be set according to the actual parameter of the driving transistor T8. In the embodiments of the present disclosure, the voltage value of the first voltage signal provided by the first voltage terminal AVEE is −5V.

It should be understood that the second terminal 32 of the storage sub-circuit 30 is coupled to the second voltage terminal GND via the fourth transistor T4. Therefore, when the voltage value of the second voltage signal from the second voltage terminal GND is 0V, the voltage value of the second terminal 32 of the storage sub-circuit 30 may be 0V. That is, after the initialization stage State1 ends, the voltage difference between the two terminals of the storage sub-circuit 30 is 5V. Besides, the voltage value of the first terminal 31 of the storage sub-circuit 30 is −5V, and the voltage value of the second terminal 32 of the storage sub-circuit 30 is 0V, that is, the voltage value of the first node J1 is 0V. Moreover, it should be noted that the absolute value of the voltage difference between the voltage of the first voltage signal provided by the first voltage terminal AVEE for the driving transistor T8 and the data voltage $V_{data}$ provided by the data line Data must be larger than the threshold voltage $V_{th}$ of the driving transistor T8, to ensure that the driving transistor T8 can be fully turned on in the turn-on voltage compensation stage State2.

In the turn-on voltage compensation stage State2, as shown in FIG. 2, all of the signals provided by the first light-emitting control signal terminal S4, the second light-emitting control signal terminal S6, and the third signal terminal S7 are maintained to be at the low level of the initial stage State1 without change. Then, the signals provided by the selection signal terminal SEL, the fourth signal terminal S3, and the second signal terminal S8 are all set to be at a high level, and meanwhile the first signal provided by the first signal terminal S5 is set to be at a low level. In this case, the selection signal, the fourth signal and the second signal are all at the high level, for example, the voltage value is +18V. The first light-emitting control signal, the second light-emitting control signal, the first signal, and the third signal are all at a low level, for example, the voltage value is −12V, so that the fifth transistor T5, the third transistor T3, the sixth transistor T6, and the seventh transistor T7 all work in the cut-off region, and the first transistor T1, the second transistor T2, and the fourth transistor T4 all work in the saturation region.

In other words, in the turn-on voltage compensation stage State2, the data voltage provided by the data line Data may be written to the driving transistor T8 by the data writing sub-circuit 10 under the control of the selection signal terminal SEL, and the storage sub-circuit 30 is charged or discharged by the data writing sub-circuit 10, the driving transistor T8 and the threshold voltage compensation sub-circuit 60. That is, the data voltage $V_{data}$ is written to the first terminal 31 of the storage sub-circuit 30 by the data writing sub-circuit 10, the driving transistor T8, and the threshold voltage compensation sub-circuit 60, and meanwhile, the threshold voltage $V_{th}$ of the driving transistor T8 is also written to the first terminal 31 of the storage sub-circuit 30 by the threshold voltage compensation sub-circuit 60, such that the voltage of the first terminal 31 of the storage sub-circuit 30 is equal to the sum of the data voltage $V_{data}$ and the threshold voltage $V_{th}$ of the driving transistor T8, i.e., $V_{data}+V_{th}$. In other words, the gate voltage of the driving transistor T8 is also $V_{data}+V_{th}$, that is, the voltage of the driving transistor T8 is compensated. Here, the data voltage $V_{data}$ may be a negative voltage.

The fourth transistor T4 works in the saturation region in the turn-on voltage compensation stage State2, and the second terminal 32 of the storage sub-circuit 30 is coupled to the second voltage terminal GND via the fourth transistor T4. Therefore, the voltage of the second terminal 32 of the storage sub-circuit 30 can maintain to be the voltage value of the second voltage signal from the second voltage terminal GND. For example, the voltage of the second terminal 32 of the storage sub-circuit 30 can maintain to be 0V, and the absolute value of the voltage difference between the two terminals of the storage sub-circuit 30 is $|V_{data}+V_{th}|$.

It should be noted that if the absolute value $|V_{data}+V_{th}|$ of the voltage difference between the two terminals of the storage sub-circuit 30 at terminal of the turn-on voltage compensation stage State2 terminals is larger than the absolute value of the voltage difference in the initialization stage State1, in the turn-on voltage compensation stage State2, the data writing sub-circuit 10, the driving transistor T8, and the threshold voltage compensation sub-circuit 60 charge the storage sub-circuit 30. If the absolute value $|V_{data}+V_{th}|$ of the voltage difference of the first terminal 31 of the storage sub-circuit 30, between the turn-on voltage compensation stage State2 and the initialization stage State1 at the end of the turn-on voltage compensation stage State2 is smaller than the absolute value of the voltage difference in the initialization stage State1, in the turn-on voltage compensation stage State2, the data writing sub-circuit 10, the driving transistor T8, and the threshold voltage compensation sub-circuit 60 discharge the storage sub-circuit 30.

In the display stage State3, as shown in FIG. 2, the signals provided by the selection signal terminal SEL, the fourth signal terminal S3, the first signal terminal S5 and the second signal terminal S8 are all set to be at a low level, for example, the voltage value may be −12V, and the signals provided by the first light-emitting control signal terminal S4, the second light-emitting control signal terminal S6 and the third signal terminal S7 are all set to be at a high level, for example, the voltage value may be +18V, so that the first transistor T1, the second transistor T2, the third transistor T3, and the fourth transistor T4 work in a cut-off region, and the fifth transistor T5, the sixth transistor T6, and the seventh transistor T7 work in a saturation region.

That is, in the display stage State3, the second terminal 32 of the storage sub-circuit 30 (i.e., the first node J1) is coupled to the third voltage terminal AVDD via the seventh transistor T7. In this case, the third voltage terminal AVDD lightens the light-emitting element D1 via the light-emitting control sub-circuit 40, and the driving transistor T8 works in a constant current region.

The voltage difference between the two terminals of the storage sub-circuit 30 at the end of the turn-on voltage compensation stage State2 is $|V_{data}+V_{th}|$, and in the display stage State3, the voltage of the second terminal 32 of the storage sub-circuit 30 (i.e., the first node J1) is pulled up to AVDD, the second transistor T2 and the third transistor T3 both work in the cut-off region, and the control electrode of the driving transistor T8 is in a floating state. Therefore, when the voltage of the first node J1 changes, the storage sub-circuit 30 can ensure that the voltage difference between the two terminals thereof does not change abruptly. That is, the voltage difference between the first node J1 and the control electrode of the driving transistor T8 can keep stable as $|V_{data}+V_{th}|$. Hence, the voltage of the first terminal 31 of the storage sub-circuit 30, i.e., the gate voltage of the driving transistor T8 is $V_{data}+V_{th}+AVDD$. Further, since the third voltage terminal AVDD is coupled to the first electrode T81 of the driving transistor T8 via the sixth transistor T6, the voltage of the first electrode T81 of the driving transistor T8 (i.e., the source voltage) is AVDD. Therefore, the gate-source voltage $U_g$s of the driving transistor T8 (i.e., the voltage difference between the gate voltage and the source voltage of the driving transistor T8) is: $U_{gs}=(V_{data}+V_{th}+AVDD)-AVDD=V_{data}+V_{th}$.

According to the drain current Id formula of the transistor: $I_d=\mu_p*C_{ox}*W/L*(U_{gs}-V_{th})^2$, wherein $\mu_p$ is the hole mobility of the transistor, $C_{ox}$ is the gate capacitance per unit area of the transistor, W is the channel width of the transistor, and L is the channel length of the transistor.

Further, it can be inferred that the drain current $I_d$ of the driving transistor T8 can be: $I_d=\mu_p*C_{ox}*W/L*(V_{data}+V_{th}-V_{th})^2=\mu_p*C_{ox}*W/L*V_{Data}^2$.

In other words, the turn-on voltage $V_{th}$ of the driving transistor T8 has no influence on the magnitude of the drain current $I_d$. That is, the influence of the turn-on voltage $V_{th}$ of the driving transistor T8 on the drain current Id is eliminated, thereby solving the problem of an abnormal display picture of the OLED display device caused by the fluctuation of the turn-on voltage $V_{th}$ of the driving transistor.

Referring to FIG. 2, it can also be seen that there is a certain time interval between the turn-on voltage compensation stage State2 and the display stage State3, that is, after the turn-on voltage compensation stage State2 ends, the display stage State3 appears after a delay of a duration. Therefore, it can be ensured that when the first light-emitting control signal terminal S4, the second light-emitting control signal terminal S6 and the third signal terminal S7 provide the high-level turn-on signals, the signals provided by the other signal terminals are all low-level turn-off signals, thereby ensuring the stability of the pixel driving circuit during working.

In summary, the pixel driving circuit according to the embodiments of the present disclosure provides the data voltage provided by the data line to the first electrode of the driving transistor under the control of the selection signal terminal. Charging or discharging is performed under the control of the signal from the control electrode of the driving transistor and the signal from the first node. The voltage difference between the first node and the control electrode of the driving transistor keeps stable when the control electrode of the driving transistor is in the floating state. The first voltage signal from the first voltage terminal is provided to the control electrode of the driving transistor under the control of the first signal terminal. The second voltage signal from the second voltage terminal or the third voltage signal from the third voltage signal terminal is provided to the first node under the control of the second signal terminal and the third signal terminal. The control electrode of the driving transistor is coupled to the second electrode of the driving transistor under the control of the fourth signal terminal, to write the data voltage and the threshold voltage of the driving transistor to the control electrode of the driving transistor. Under the control of the first light-emitting control signal, the second electrode of the driving transistor and the first terminal of the light-emitting element are turned on. Under the control of the second light-emitting control signal terminal, the first electrode of the driving transistor and the third voltage terminal are turned on to control the light-emitting element to emit light. Therefore, the pixel driving circuit according to the embodiment of the present disclosure can eliminate the influence of the turn-on voltage of the driving transistor on the light-emitting brightness of the light-emitting element, thereby solving the problem of the abnormal display picture of the OLED display device caused by the fluctuation of the turn-on voltage of the driving transistor, and ensuring the uniformity of the display brightness of the OLED display device.

Figure 3:
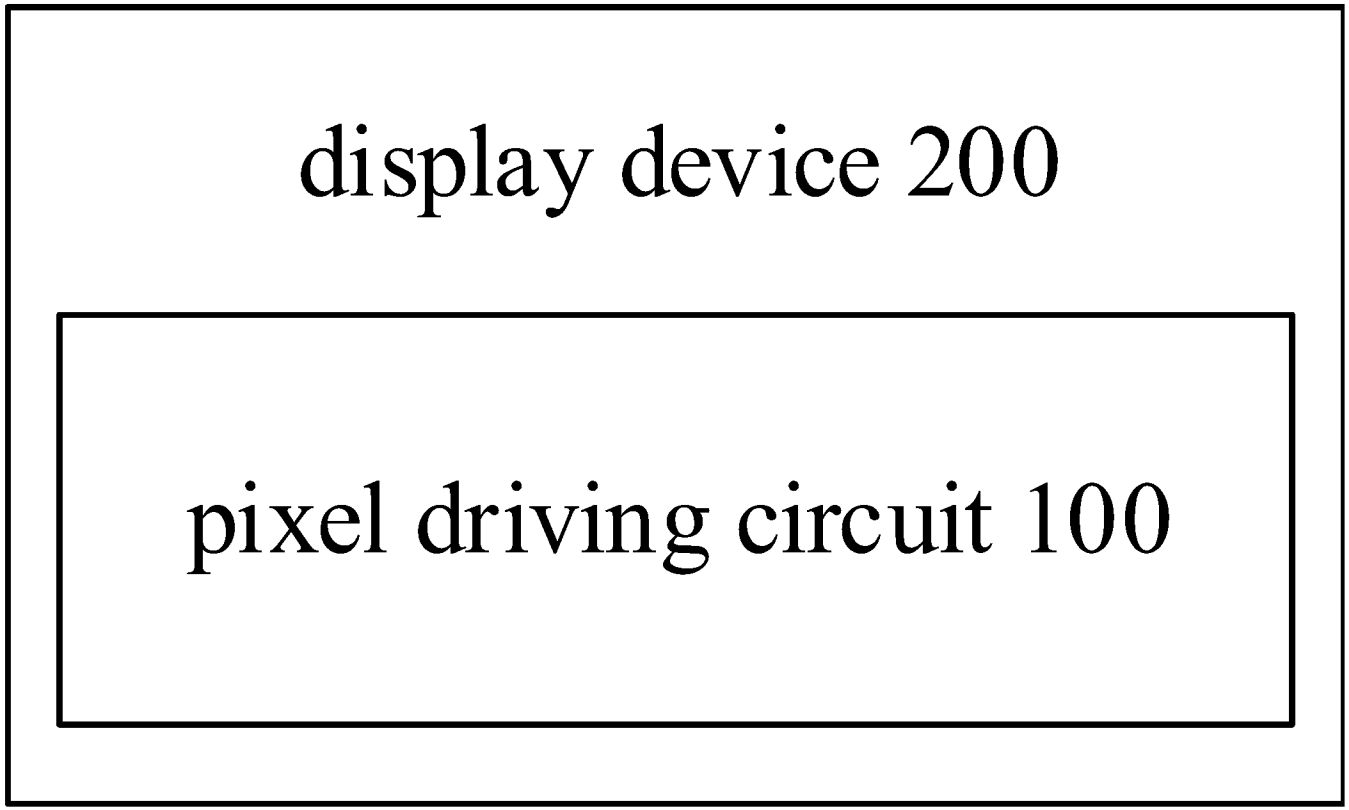
FIG. 3 is a schematic diagram of a structure of a display device according to an embodiment of the present disclosure.

An embodiment of the present disclosure further provides a display device. As shown in FIG. 3, the display device 200 according to the embodiment of the present disclosure includes a pixel driving circuit 100, which can be the pixel driving circuit as shown in FIG. 1.

Figure 4:
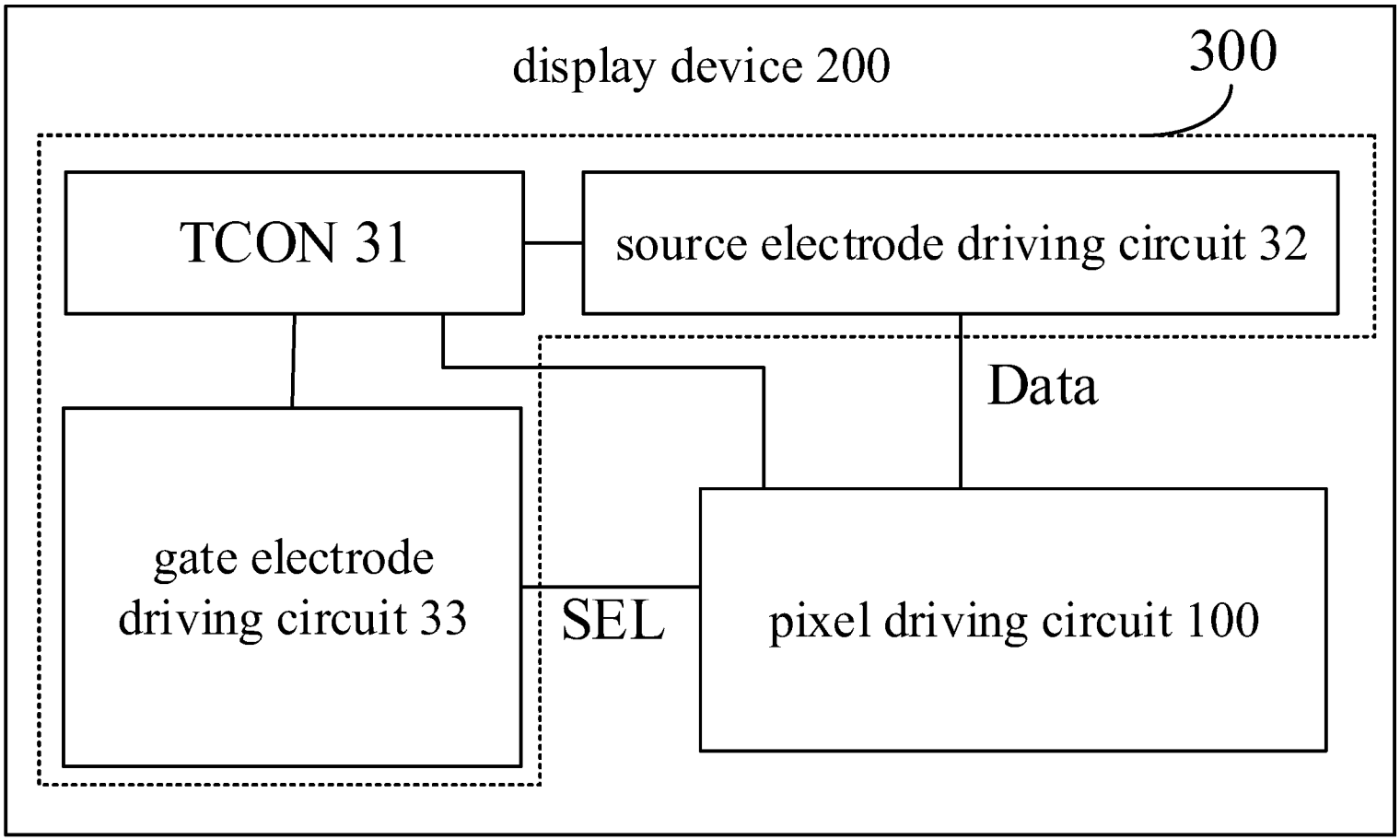
FIG. 4 is a schematic diagram of a structure of another display device according to an embodiment of the present disclosure.

Optionally, as shown in FIG. 4, the display device may further include a driving device 300. The driving device 300 is coupled to the data line Data and each signal terminal respectively, and configured to control the data voltage $V_{data}$ of the data line Data and the voltage of the signal provided by each signal terminal.

For example, referring to FIG. 4, the driving device 300 may include a timing controller (TCON) 31, a source electrode driving circuit 32, and a gate electrode driving circuit (gate IC) 33. The source electrode driving circuit 32 may be a driver integrated circuit (driver IC). The gate electrode driving circuit 33 may be a gate integrated circuit (gate IC). The TCON 31 may be coupled to a first signal terminal S5, a second signal terminal S8, a third signal terminal S7, a fourth signal terminal S3, a first light-emitting control signal terminal S4, and a second light-emitting control signal terminal S6 (the above signal terminals are not shown in FIG. 4) respectively, and configured to control the voltage of the signal provided by each signal terminal. The source electrode driving circuit 32 is coupled to the TCON 31 and the data line Data respectively, and configured to control the data voltage $V_{data}$ of the data line Data under the control of the TCON 31. The gate electrode driving circuit 33 is coupled to the TCON 31 and the selection signal terminal SEL respectively, and configured to control the voltage of the selection signal provided by the selection signal terminal SEL under the control of the TCON 31.

With the display device in the embodiments of the present disclosure, by the pixel driving circuit, the problem of the abnormal display picture of the OLED display device caused by the fluctuation of the turn-on voltage of the driving transistor can be eliminated, and the uniformity of the display brightness of the OLED display device is better.

Optionally, the display device may be a liquid crystal display device, an electronic paper, an OLED display device, a mobile phone, a tablet computer, a TV, a display, a laptop computer, a digital photo frame, a navigator, or any product or part with a display function.

Figure 5:
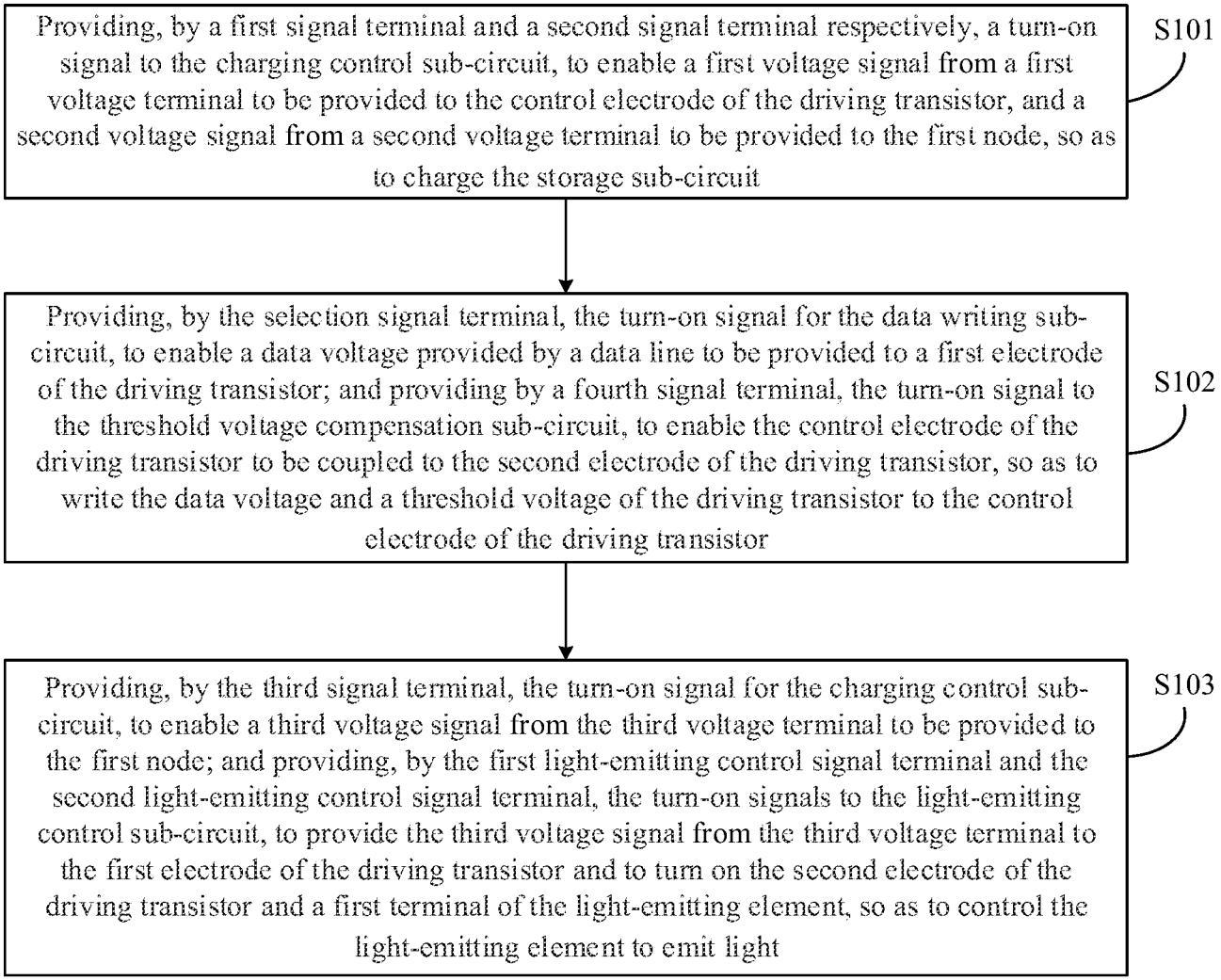
FIG. 5 is a flow chart of a driving method of a pixel driving circuit according to an embodiment of the present disclosure.

FIG. 5 is a flow chart of a driving method of a pixel driving circuit according to an embodiment of the present disclosure. The pixel driving circuit includes a data writing sub-circuit, a driving transistor, a storage sub-circuit, a light-emitting control sub-circuit, a charging control sub-circuit, and a threshold voltage compensation sub-circuit and a light-emitting element.

As shown in FIG. 5, the driving method of a pixel driving circuit according to an embodiment of the present disclosure may include following steps.

In step S101, a first signal terminal and a second signal terminal provide turn-on signals to the charging control sub-circuit respectively, to enable the first voltage signal from a first voltage terminal to be provided to the control electrode of the driving transistor, and the second voltage signal from a second voltage terminal to be provided to the first node, to charge the storage sub-circuit.

Here, the turn-on signal may be referred to as the signal for turning on the transistors in the sub-circuits.

Optionally, in step S101, the selection signal terminal, the third signal terminal, the fourth signal terminal, the first light-emitting control signal terminal, and the second light-emitting control signal terminal all may provide turn-off signals. The turn-off signal may be referred to as the signal for turning off the transistors in the sub-circuits. For example, the turn-on signal is a high-level signal relative to the turn-off signal, that is, the level of the turn-on signal may be higher than the level of the turn-off signal.

In step S101, the pixel driving circuit may be in the initialization stage State1 and the working principle thereof may be made reference to the relevant description about the initialization stage State1 above, which is not repeated here.

In step S102, the selection signal terminal provides the turn-on signal for the data writing sub-circuit, to enable the data voltage provided by a data line to be provided to the first electrode of the driving transistor, and a fourth signal terminal provides the turn-on signal for the threshold voltage compensation sub-circuit, to enable the control electrode of the driving transistor to be coupled to the second electrode of the driving transistor, to write the data voltage and the threshold voltage of the driving transistor to the control electrode of the driving transistor.

Optionally, in step S102, the second terminal also provides the turn-on signal, and the first signal terminal, the third signal terminal, the first light-emitting control signal terminal and the second light-emitting control signal terminal all provide the turn-off signals.

In step S102, the pixel driving circuit may be in the turn-on voltage compensation stage State2 and the working principle thereof may be made reference to the relevant description about the turn-on voltage compensation stage State2 above, which is not repeated here.

In step S103, the third signal terminal provides the turn-on signal to the charging control sub-circuit, to enable the third voltage signal from the third voltage terminal to be provided to the first node; and the first light-emitting control signal terminal and the second light-emitting control signal terminal provide the turn-on signals to the light-emitting control sub-circuit, to provide the third voltage signal from the third voltage terminal to the first electrode of the driving transistor, and turn on the second electrode of the driving transistor and the first terminal of the light-emitting element, to control the light-emitting element to emit light.

Optionally, in step S103, the selection signal terminal, the first signal terminal, the second signal terminal and the fourth signal terminal all provide the turn-off signals.

In step S103, the pixel driving circuit may be in the display stage State3 and the working principle thereof may be made reference to the relevant description about the display stage State3 above, which is not repeated here.

Optionally, in step S101 to step S103, the turn-on signals all may be signals with a voltage value of 18V and the turn-off signals all may be signals with a voltage value of −12V.

Optionally, the absolute value of the difference between the voltage of the first voltage signal and the data voltage is larger than the threshold voltage of the driving transistor.

Optionally, the selection signal provided by the selection signal terminal is the same as the fourth signal provided by the fourth signal terminal.

Optionally, the third signal provided by the third signal terminal, the first light-emitting control signal provided by the first light-emitting control signal terminal and the second light-emitting control signal provided by the second light-emitting control signal terminal are the same.

Optionally, the voltage of the second voltage signal may be 0, the voltage of the first voltage signal may be a negative signal, for example, −5V, and the voltage of the third voltage signal may be a positive signal, for example, 5V.

In summary, according to driving method of the pixel driving circuit provided by the embodiments of the present disclosure, the first signal terminal and the second signal terminal provide the turn-on signals to the charging control sub-circuit respectively, to enable the first voltage signal from the first voltage terminal to be provided to the control electrode of the driving transistor and the second voltage signal from the second voltage terminal to be provided to the first node to charge the storage sub-circuit. The selection signal terminal writes the turn-on signal to the data writing sub-circuit to enable the data voltage provided by the data line to be provided to the first electrode of the driving transistor, and the fourth signal terminal provides the turn-on signal to the threshold voltage compensation sub-circuit, to enable the control electrode of the driving transistor to be coupled to the second electrode of the driving transistor, to write the data voltage and the threshold voltage of the driving transistor to the control electrode of the driving transistor. The third signal terminal provides the turn-on signal to the charging control sub-circuit, to enable the third voltage signal from the third voltage terminal to be provided to the first node, and the first light-emitting control signal terminal and the second light-emitting control signal terminal provide the turn-on signals to the light-emitting control sub-circuit, to provide the third voltage signal from the third voltage terminal to the first electrode of the driving transistor, and turn on the second electrode of the driving transistor and the first terminal of the light-emitting element, to control the light-emitting element to emit light. Therefore, according to the driving method in the embodiments of the present disclosure, the influence of the turn-on voltage of the driving transistor on the light-emitting brightness of the light-emitting element can be eliminated, thereby solving the problem of the abnormal display picture of the OLED display device caused by the fluctuation of the turn-on voltage of the driving transistor.

Any process or method descriptions described in the flowcharts or otherwise herein may be understood as representing code modules, code segments or portions of codes that include one or more executable instructions for implementing the steps of a customized logical function or process. In addition, the scope of the exemplary embodiments of the present disclosure includes further implementations in which functions may not be performed in the sequence shown or discussed, and may be performed substantially simultaneously or in an inverse sequence based on the involved functions, which should be understood by those skilled in the art.

Logic and/or steps, which are shown in the flowcharts or otherwise described herein, for example, may be considered as a sequence list of executable instructions for implementing logic functions, which may be specifically implemented in any computer-readable medium, for the use of an instruction execution system, apparatus or device (such as a computer-based system, a system including a processor, or other system that may obtain instructions from the instruction execution system, apparatus or device and execute the instructions), or for the use in combination with the instruction execution system, apparatus or device. For this specification, the "computer-readable medium" may be any apparatus that can contain, store, communicate, propagate, or transport programs for the use of the instruction execution system, apparatus or device or for the use of in connection with the instruction execution system, apparatus or device. More specific examples (a non-exhaustive list) of the computer readable medium include the followings: an electrical connection part (electronic device) having one or more wires, a portable computer disk cartridge (magnetic device), a random access memory (RAM), a read only memory (ROM), an erasable editable read only memory (EPROM or flash memory), a fiber optic device, and a portable compact disk read only memory (CDROM). In addition, the computer readable medium may even be paper or other suitable mediums on which the programs can be printed, since for example, the paper or other suitable mediums may be optically scanned, then editing and interpretation are performed, or processing is performed in other suitable manners when necessary to obtain the program electronically and then the program is stored in a computer memory.

It should be understood that various portions of the present disclosure may be implemented by hardware, software, firmware, or a combination thereof. In the above embodiments, a plurality of steps or methods may be implemented by software or firmware that are stored in the memory and executed by a suitable instruction execution system. For example, if implemented with hardware, as in another embodiment, they may be implemented by any one or a combination of the following techniques well known in the art: a discrete logic circuit having a logic gate circuit having logic gates for implementing logic functions of data signals, an application-specific integrated circuit with a suitable combinational logic gate circuit, a programmable gate array (PGA), a field programmable gate array (FPGA) or the like.

Persons of ordinary skill in the art can understand that all or part of the steps described in the above embodiments can be completed through hardware instructed by programs which may be stored in a non-transitory computer readable storage medium. The programs, when operating, perform one of the steps in the method embodiments or a combination thereof.

The above-mentioned storage medium may be a read-only memory, disk or CD, etc. Although the embodiments of the present disclosure have been shown and described above, it can be understood that the above embodiments are exemplary only and cannot be understood as limiting the present disclosure. Persons of ordinary skill in the art can make changes, modifications, substitutions and variations to the above embodiments within the scope of the present disclosure.

What is claimed is:

1. A driving method for driving a pixel driving circuit, wherein the pixel driving circuit comprises a light-emitting element, a driving transistor, a storage sub-circuit, a data writing sub-circuit, a light-emitting control sub-circuit, a charging control sub-circuit, and a threshold voltage compensation sub-circuit, wherein the data writing sub-circuit is coupled to the driving transistor and configured to provide a data voltage provided by a data line to a first electrode of the driving transistor under the control of a selection signal terminal;

the storage sub-circuit is coupled to a control electrode of the driving transistor and a first node respectively, and is configured to perform one of the following operations: being charged and discharged, under the control of a signal from the first node and a signal from the control electrode of the driving transistor;

the charging control sub-circuit is coupled to the first node and the control electrode of the driving transistor respectively, and configured to provide a first voltage signal from a first voltage terminal to the control electrode of the driving transistor under the control of a first signal terminal and provide a second voltage signal from a second voltage terminal or a third voltage signal from a third voltage terminal to the first node under the control of a second signal terminal and a third signal terminal;

the threshold voltage compensation sub-circuit is coupled to the control electrode of the driving transistor and a second electrode of the driving transistor respectively, and configured to couple the control electrode of the driving transistor to the second electrode of the driving transistor under the control of a fourth signal terminal, to write the data voltage and a threshold voltage of the driving transistor to the control electrode of the driving transistor; and the light-emitting control sub-circuit is coupled to the light-emitting element, the driving transistor, and the charging control sub-circuit respectively, and configured to turn on the second electrode of the driving transistor and a first terminal of the light-emitting element under the control of a first light-emitting control signal terminal, and turn on the first electrode of the driving transistor and the third voltage terminal under the control of a second light-emitting control signal terminal, to control the light-emitting element to emit light;

and the driving method comprises:

providing, by a first signal terminal and a second signal terminal respectively, a turn-on signal to the charging control sub-circuit, to enable a first voltage signal from a first voltage terminal to be provided to the control electrode of the driving transistor, and a second voltage signal from a second voltage terminal to be provided to the first node, to charge the storage sub-circuit;

providing, by the selection signal terminal, the turn-on signal to the data writing sub-circuit, to enable a data voltage provided by a data line to be provided to a first electrode of the driving transistor; and providing by a fourth signal terminal, the turn-on signal to the threshold voltage compensation sub-circuit, to enable the control electrode of the driving transistor to be coupled to the second electrode of the driving transistor, to write the data voltage and a threshold voltage of the driving transistor to the control electrode of the driving transistor; and providing, by the third signal terminal, the turn-on signal to the charging control sub-circuit, to enable a third voltage signal from the third voltage terminal to be provided to the first node; and providing, by the first light-emitting control signal terminal and the second light-emitting control signal terminal, the turn-on signals to the light-emitting control sub-circuit, to provide the third voltage signal from the third voltage terminal to the first electrode of the driving transistor and to turn on the second electrode of the driving transistor and a first terminal of the light-emitting element, to control the light-emitting element to emit light;

wherein the selection signal terminal, the third signal terminal, the fourth signal terminal, the first light-emitting control signal terminal, and the second light-emitting control signal terminal all provide turn-off signals when the first signal terminal and the second signal terminal both provide the turn-on signals;

the second signal terminal provides the turn-on signal, and the first signal terminal, the third signal terminal, the first light-emitting control signal terminal and the second light-emitting control signal terminal all provide the turn-off signals when the selection signal terminal and the fourth signal terminal both provide the turn-on signals; and the selection signal terminal, the first signal terminal, the second signal terminal and the fourth signal terminal all provide the turn-off signals when the third signal terminal, the first light-emitting control signal terminal, and the second light-emitting control signal terminal all provide the turn-on signals.

2. The driving method according to claim 1, wherein an absolute value of a difference between a voltage of the first voltage signal and the data voltage is larger than the threshold voltage of the driving transistor.

3. The driving method according to claim 1, wherein a selection signal provided by the selection signal terminal is the same as a fourth signal provided by the fourth signal terminal.

4. The driving method according to claim 1, wherein a third signal provided by the third signal terminal, a first light-emitting control signal provided by the first light-emitting control signal terminal, and a second light-emitting control signal provided by the second light-emitting control signal terminal are the same.

5. The driving method according to claim 1, wherein the turn-on signal is a high-level signal relative to the turn-off signal.

6. The driving method according to claim 1, wherein a voltage of the second voltage signal is 0, a voltage of the first voltage signal is a negative voltage, and a voltage of the third voltage signal is a positive voltage.

* * * * *